US005722495A

United States Patent [19]

Rear

[11] Patent Number: 5,722,495

[45] Date of Patent: Mar. 3, 1998

[54] MAKE UP SYSTEM OF A DOWN-THE-HOLE HAMMER

[76] Inventor: Ian Graeme Rear, 24 Hanwell Way, Bassendean, Australia

[21] Appl. No.: 617,813

[22] PCT Filed: Sep. 19, 1994

[86] PCT No.: PCT/AU94/00558

§ 371 Date: Mar. 20, 1996

§ 102(e) Date: Mar. 20, 1996

[87] PCT Pub. No.: WO95/08690

PCT Pub. Date: Mar. 30, 1995

[30] Foreign Application Priority Data

Sep. 20, 1993 [AU] Australia ..... PM1339

[51] Int. Cl.[6] ..... E21B 4/06

[52] U.S. Cl. ..... 175/296; 175/417

[58] Field of Search ..... 175/293, 296, 175/414, 417, 318, 324

[56] References Cited

FOREIGN PATENT DOCUMENTS

| | | |
|---|---|---|
| 48142 | 3/1982 | European Pat. Off. . |
| 1 245 617 | 9/1971 | United Kingdom . |
| 1 246 388 | 9/1971 | United Kingdom . |
| 1 275 900 | 5/1972 | United Kingdom . |
| 1 424 494 | 2/1976 | United Kingdom . |

*Primary Examiner*—William P. Neuder
*Attorney, Agent, or Firm*—Merchant, Gould, Smith, Edell, Welter & Schmidt

[57] ABSTRACT

A make-up system of a down-the-hole hammer. The down-the-hole hammer is of the type comprising a hammer casing (111) having a top sub (112) mounted to one end and a drill bit chuck mounted to the other end. The casing accommodates a piston which is caused to reciprocate within the hammer casing. The make up system comprises: a fluid flow delivery or valving assembly (121) to be supported at the one end of the hammer casing having an annular flange (117) thereon where the annular flange (117) is capable of being slidably received within the hammer casing (111); an annular recess (122) formed in the wall of the hammer casing (111); a retainer ring (123) supported from the recess (122) and extending inwardly beyond the inner face of the hammer casing (111), the flange (117) being formed with an annular rebate (124) around its perimeter adjacent the inner axial face to define a space between the retainer ring, the flange, and the side wall of the hammer casing, a compressible ring (126) also received in the recess (122) and located in the space, the compressible ring (126) being compressed to fill the space as a result of the clamping forces applied by the fixing of the top sub (112) to the hammer casing (111).

17 Claims, 4 Drawing Sheets

MAKE UP SYSTEM OF A DOWN-THE-HOLE HAMMER

THIS INVENTION relates to the make-up system of down the hole hammers for supporting components such as the valving system, check valve, control rods, cylinders or like fixed internal components within the hammer casing.

Down the hole hammers (hereinafter referred to "of the type specified) to which the invention relates comprises a hammer casing which has a top sub mounted to one end and supports a drill bit chuck at the other end, the casing accommodates a piston between the top sub and the drill bit chuck which is caused to reciprocate within the hammer casing. The reciprocation of the piston is effected by the delivery of high pressure air to the hammer. Such high pressure air can be delivered to the space within the hammer casing by a variety of valving systems which can comprise; a valve body and assembly with moving components; or an internal cylinder incorporating porting; or a central axial control rod and a check valve assembly; which are each removably supported at the one end of the hammer casing between the top sub and a shoulder or flange formed in the hammer casing or a retainer ring which is snugly received in a recess formed in the wall of the hammer casing. Throughout the specification the term "valving system" shall be taken to include any form of fluid delivery system including that described above which are utilised in down the hole hammers.

It has been found that in the past, the manufacture of down the hole hammers of the type specified, significant costs are incurred in machining the hammer casing, internal cylinders, and components of the valve system to very close tolerances such that they are suitably located and adequately supported and accommodated within the hammer assembly over the life of the hammer to be able to withstand the cyclic forces, inertial forces and stresses which are incurred as a result of the normal operation of the hammer. In addition, such machining can result in a significant reduction in the wall thickness at the ends of the hammer casing in comparison to the wall thickness of the central portion of the hammer casing which accommodates the piston. The system of supporting the above components is hereafter referred to as the "make-up system".

It is an object of this invention to reduce the fabrication costs of a down the hole hammer through a modification of the make up system and the method of retention of the valving system and to maximise the internal bore of the hammer casing in the portion which accommodates the piston in order to maximise the diameter of the piston for a given hammer casing outside diameter. In addition, this support needs to be provided over the life of the hammer.

In one form the invention resides in a make up system of a down the hole hammer of the type specified comprising an air flow delivery or valving assembly to be supported at said one end of the hammer casing having an annular flange thereon where the annular flange is capable of being slidably received within the hammer casing, an annular recess formed in the wall of the hammer casing, a retainer ring supported from said recess and extending inwardly beyond the inner face of the hammer casing, said flange being formed with an annular rebate around its perimeter adjacent the inner axial face to define a space between the retainer ring, the flange and the side wall of the hammer casing, a compressible ring also received in the recess and located in the space; said compressible ring being compressed to fill the space as a result of the clamping forces applied by the fixing of the top sub to the hammer casing.

According to a preferred feature of the invention the retainer ring is formed of a plurality of segments. In addition, the recess may be formed of two axially spaced annular portions separated by an intermediate rib portion and wherein the outer circumferential face of the retainer ring is formed of a complementary configuration to be received in the recess to both sides of the rib portion.

According to a further preferred feature of the invention the recess has a width corresponding substantially to the width of both the retainer ring and the compressible ring.

According to a further preferred feature of the invention the circumferential face of the annular rebate is tapered inwardly such that its diameter at its innermost extent corresponds substantially to the inner diameter of the retainer ring. In addition, if desired the flange may be formed with a non tapered extension beyond the rebate.

The invention will be more fully understood in the light of the following description of one specific embodiment. The description is made with reference to the accompanying drawings of which:

Figure 1:
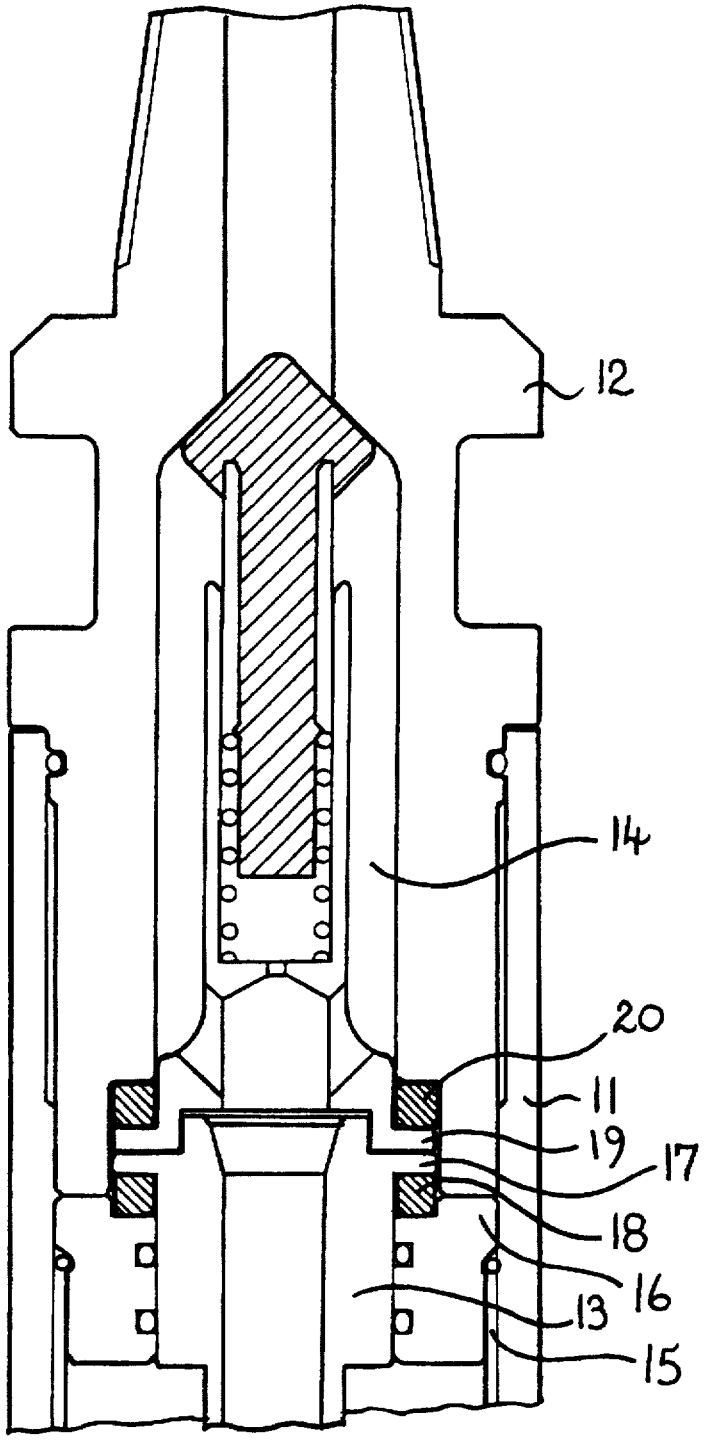
FIG. 1 is a schematic sectional elevation of a portion of a down the hole hammer of the type specified according to the prior art.

As shown at FIG. 1 the down the hole hammers according to the prior art have comprised a hammer casing 11 which support a top sub 12 from one end. The hammer casing 11 further supports a drill chuck from its other end (not shown) and a piston (not shown) is accommodated between the top sub and the drill chuck for reciprocation within the hammer casing 11. The hammer casing 11 further supports a control rod 13 and a check valve assembly 14 for the delivery of fluid to the hammer to cause reciprocation of the piston.

The support provided for the control rod 13 is effected by means of a make-up system which has in the past comprised an annular shoulder 15 which is formed on the inner face of the hammer casing and a rigid make up ring 16 which engages with the shoulder 15 and in turn supports the flange 17 of the control rod via a first compressible make-up ring 18. The check valve assembly 14 is also formed with a flange 19 at its innermost end and a second compressible make-up ring 20 overlies that flange 19. The control rod and check valve assembly 18 are clampingly retained in place by the top sub 12 when it is threadably engaged with the hammer casing 11 such that flanges 17 and 19 are clamped together through the compressible make up rings 18 and 20 between the top sub 12 and the rigid make up ring 16.

The manufacture of the make up system discussed above and as shown at FIG. 1 involves a considerable amount of machining and the use of a considerable amount of material with very close tolerances.

It is an object of the embodiment to provide a make up system which simplifies the support provided for the valving system, which comprises a control rod and check valve assembly, within a down the hole hammer of the type specified.

Figure 2:
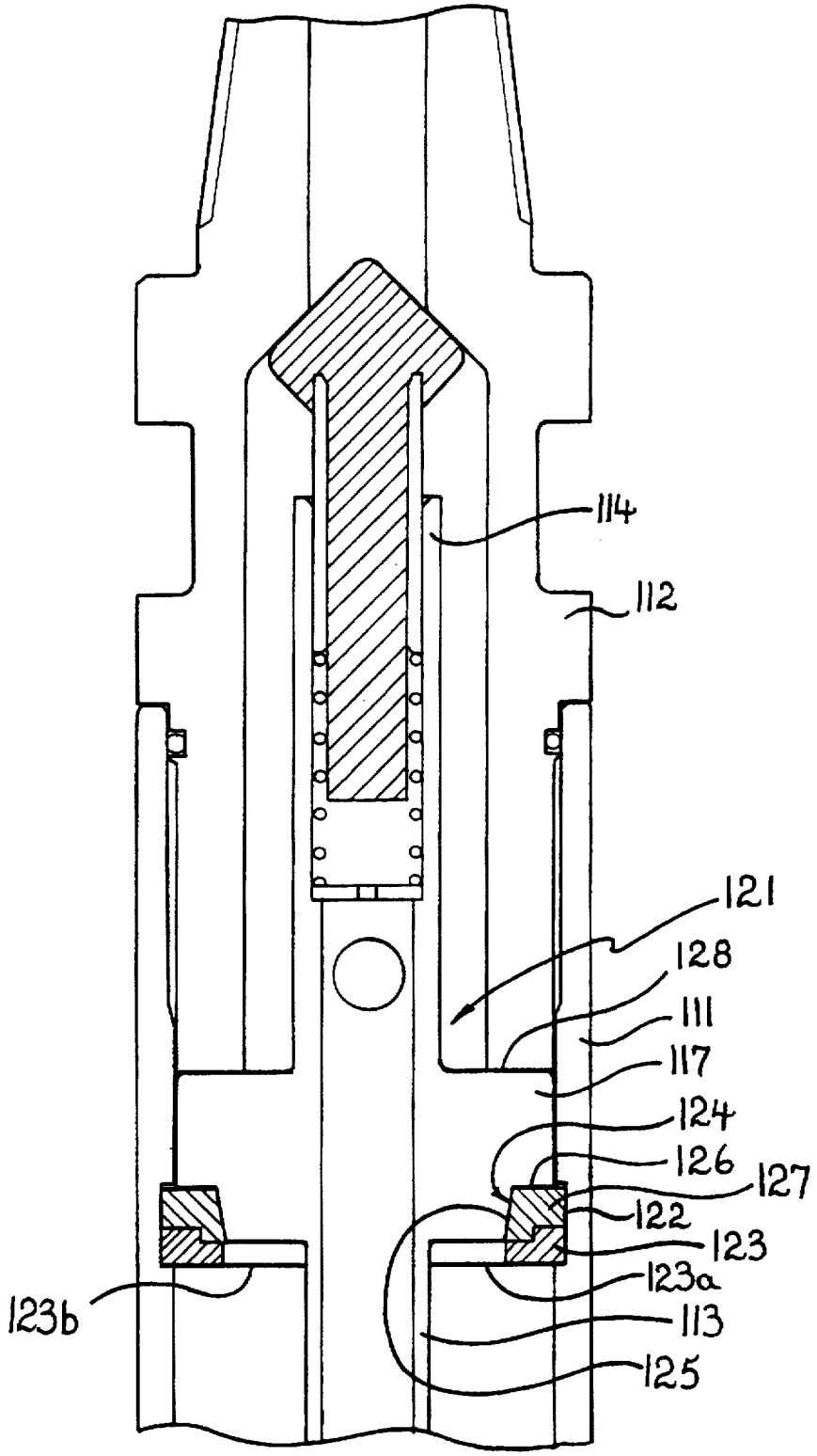
FIG. 2 is a sectional elevation of a portion of a down the hole hammer of the type specified according to a first embodiment of the invention.

FIG. 2 illustrates the first embodiment of the invention which comprises a hammer casing 111 which supports a top sub 112 from its one end. The other end of the hammer casing 111 supports a drill chuck (not shown) and a piston (not shown) is accommodated between the top sub 112 and the drill chuck for reciprocation in the space so defined. Operation of the hammer is effected by means of high pressure air which is delivered to the hammer via the top sub 112 through a check valve assembly 114 and a control rod 113. In the case of the embodiment both the valve assembly 114 and control rod 113 are formed as a single integral unit (now referred to as the control rod assembly 121) which is provided with an annular flange 117. The outer diameter of the flange 117 corresponds substantially to the inner diameter of the hammer casing 111.

To support the control rod assembly 121 within the hammer casing 111, an annular recess 122 is formed in the wall of the hammer casing 111. The recess receives and supports a retainer ring 123 which has an outer diameter corresponding to the inner diameter of the recess 122 and which has an inner diameter which is less than the inner diameter of the hammer casing 11 such that it extends into the space defined within the hammer casing 111. The retainer ring 123 is formed of two semicircular segments to facilitate its location into the recess 122 during assembly of the hammer.

The recess 122 has a width which is greater than that of the retainer ring 123. In addition, the flange 117 of the control rod assembly 121 is formed with an annular rebate 124 on its outer face adjacent its innermost axial face. The inner most radial face 124 of the rebate is tapered inwardly such that its innermost end it has a diameter which substantially corresponds to the innermost diameter of the retainer ring 123.

A resiliently compressible ring formed of rubber, polyurethane or a like material is also received in the recess 122, between the retainer ring 123 and the axial face 126 of the rebate 124, to substantially fill the space defined between the retainer ring 123, the rebate 124 and the recess 122.

The outermost axial face of the retainer ring 123 is stepped such that its innermost ring has a reduced width. The opposing face of the compressible ring 127 is formed of a complementary configuration. The effect of such is that on location of the compressible ring 127 in position within the hammer casing it will positively retain the segments 123*a* and 123*b* of the retainer ring 123 in position, prior to the application of the control rod assembly.

On application of the top sub 112 to the hammer casing 11 the inner end 128 bears directly against the outermost axial face 129 of the flange 117 and as a result of the application of the top sub 112 the compressible ring 127 is compressed substantially to its full extent. The effect of such compression is that it is deformed to fully accommodate to the space defined between the retainer ring 123 the rebate 124 of the flange 117 and the recess 122. This compression and filling of the space is further enhanced by the tapered configuration of the radial face 125 of the rebate 124.

In assembly of the hammer of the form shown at FIG. 2 the segments 123*a* and 123*b* of the retainer ring 123 are located in position in the recess 122. The compressible ring 127 is then located in position which serves to retain the retainer ring in position. The control rod assembly 121 is then inserted into the hammer casing such that the rebate 124 of the flange 117 engages the compressible ring 127. The top sub 112 is then threadably engaged with the hammer casing 11 to cause the compression of the compressible ring 127.

As a result of the embodiment, the fabrication of the hammer is greatly simplified, due to the absence of the utilisation of a make up ring and by the provision in the embodiment of a single recess 122 in the wall of the hammer casing 111 to provide support for the valving assembly. In addition, the degree of machining and the requirements for very close tolerances between many components is significantly reduced.

Figure 3:
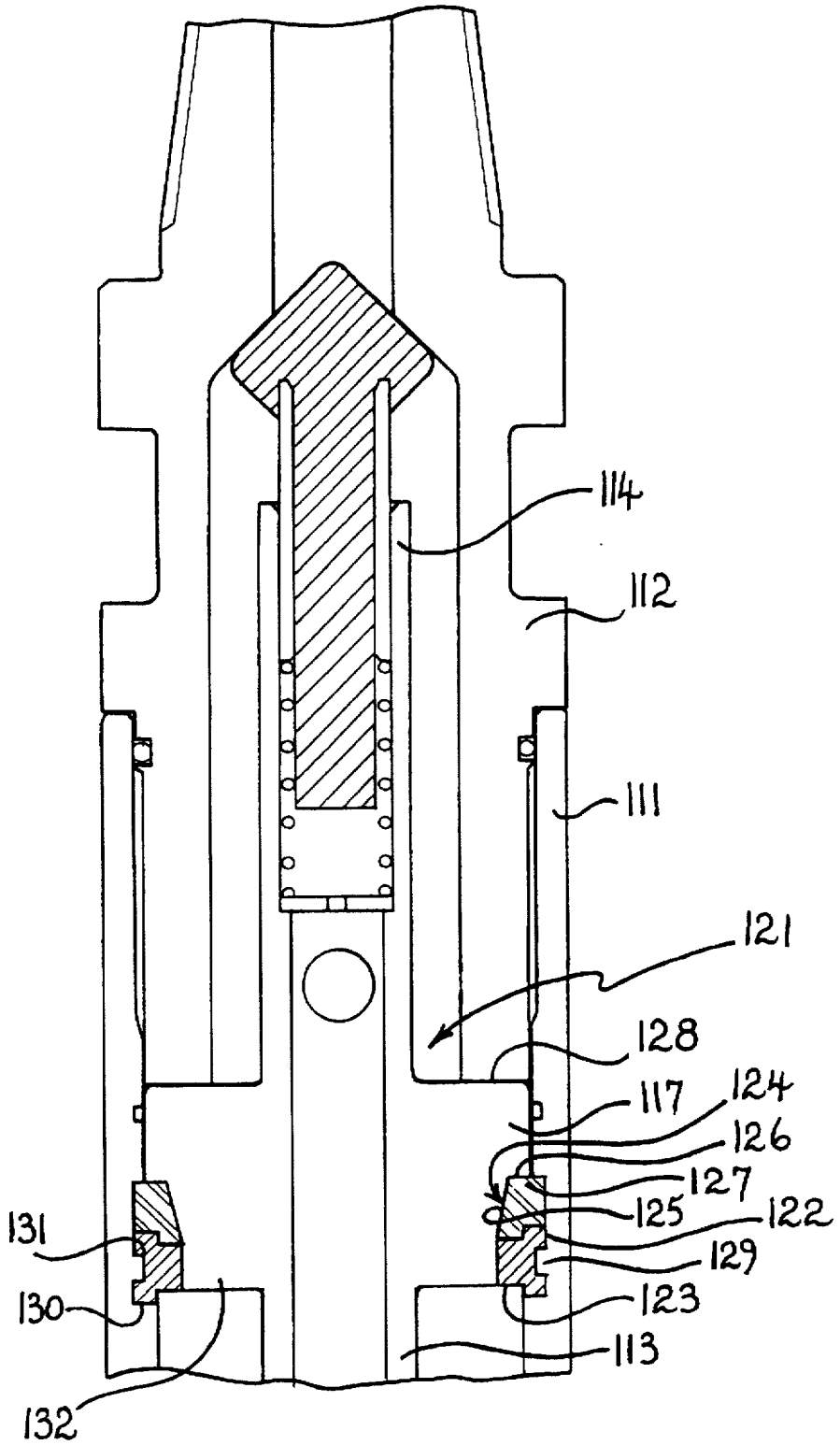
FIG. 3 is a sectional elevation of a down the hole hammer of the type specified according to a second embodiment of the invention.
Figure 4:
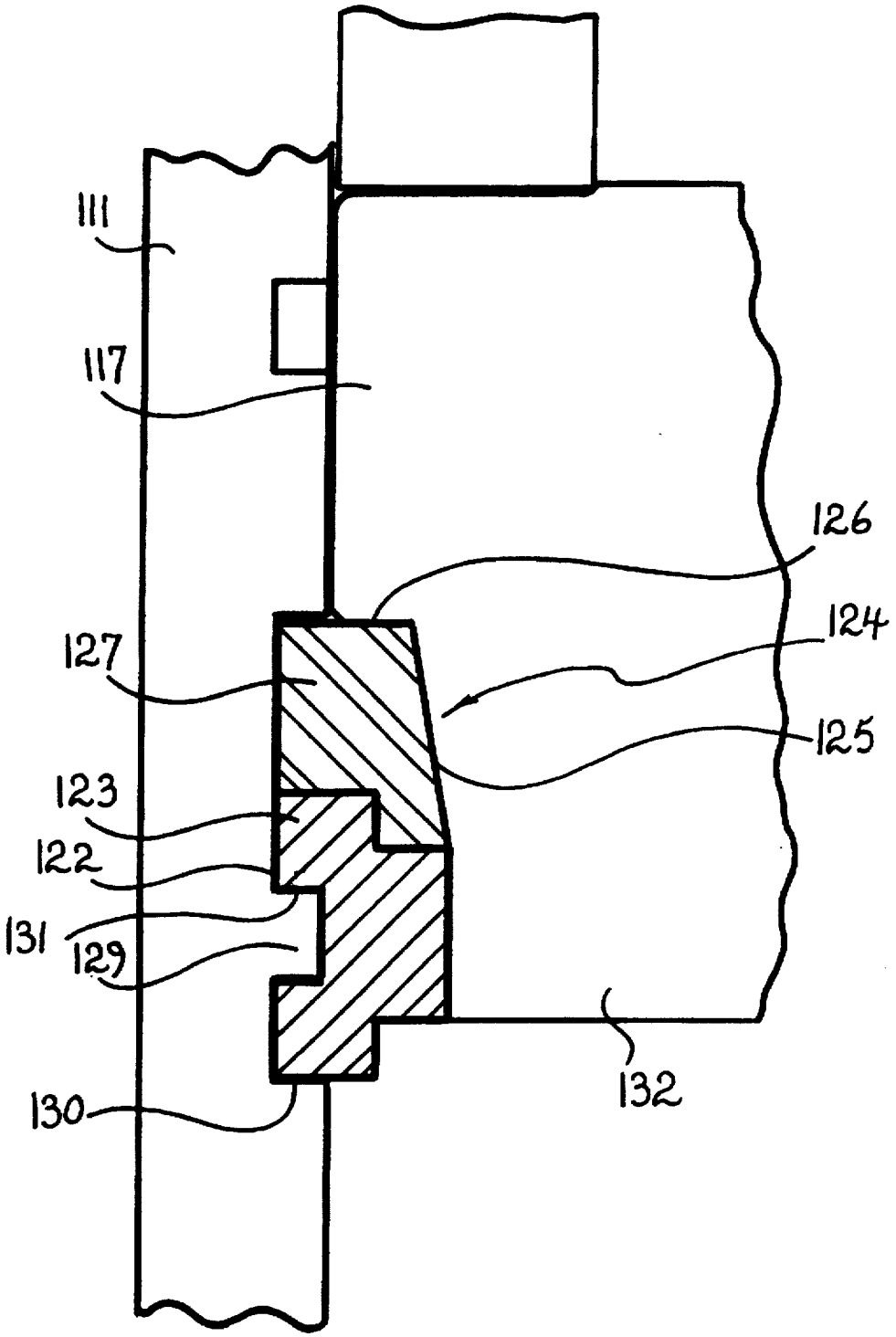
FIG. 4 is an enlarged sectional view illustrating that the interengagement between the flange and retainer ring of the second embodiment as shown at FIG. 3.

The second embodiment of the invention as shown at FIGS. 3 and 4 is of a similar construction to that of the first embodiment and the same reference numerals have been used for corresponding components. The distinguishing characteristic between the first and second embodiment comprises the configuration of the recess 122 and the retaining ring 123. In the case of the second embodiment the recess 122 is of a substantially constant diameter with the exception of a rib 129 which is formed towards the innermost extent of the recess to form two axially spaced annular portions. The outer radial face of the retainer ring is formed to have a complementary configuration such that it surrounds the rib 129. The function of the rib 129 is to provide a recess with two axially spaced axial faces 130 and 131. One axial face 130 comprises the innermost axial face of the recess 122 while the other axial face 131 comprises the outermost axial face of the rib 129. Each of the axial faces 130 and 131 provide a bearing surface for the retainer ring 123 and thus serve to increase the surface area of the bearing surface which is available to the retainer ring over the arrangement shown and described in relation to the first embodiment. In addition, the provision of the rib 129 enables the depth of the recess to be reduced while ensuring the bearing surface is of an adequate area for the anticipated forces to be borne by the bearing surface.

In addition, the second embodiment differs from the first embodiment in that the flange 117 is formed with an axial extension 132 beyond the rebate 124. The extension 132 is of a non tapered configuration and has an outer diameter which to enable the extension to be received within the retainer ring 123. The extension 132 has a width corresponding substantially to the width of the innermost face of the retainer ring 123. The extension 132 serves to provide a retention means for the retainer ring 123 when the control rod 121 is in position within the hammer casing 111.

In the case of both embodiments the compressible ring 127 may in use become hardened or vulcanised as a result of the heat generated by the operation of the down the hole hammer however it is believed that this should not detract from the function that the compressible ring serves.

In the case of both embodiments the hammer casing may be formed with an uncontoured bore with the exception of the recess 122 and if desired may be reversible by providing a recess at each end of the casing.

Both of the embodiments provides a make up assembly which is simpler in its form than that which has been utilised previously and which involves less labour and less machining of components with very close tolerances.

If desired the control rod assembly 121 may be formed as two separate components as has been utilised previously with appropriate O-rings being provided between the opposed faces. The O-rings need be provided for the purposes of sealing only.

It should be appreciated that the scope of the present invention need not be limited to the particular scope of the embodiment described above.

The claims defining the invention are as follows:

1. A make up system of a down-the-hole hammer, where the down-the-hole hammer includes a hammer casing which has a top sub mounted to one end and supports a drill chuck at the other end, the casing accommodating a piston between the top sub and the drill chuck which is caused to reciprocate within the hammer casing, the top sub being adapted to be connected to a source of high pressure fluid, said top sub accommodating a valving system for controlling the delivery of fluid to the space within the casing, said make up system comprising: the valving system to be supported at one end of the hammer casing and having an annular flange thereon where the annular flange is capable of being slidably received within the hammer casing; an annular recess formed in the wall of the hammer casing; a retainer ring supported from said recess and extending inwardly beyond the inner face of the hammer casing, said flange being formed with an annular rebate around its perimeter adjacent the inner axial face to define a space between the retainer ring, the flange, and the side wall of the hammer casing, a compressible ring also received in the recess and located in the space, said compressible ring being compressed to fill the space as a result of the clamping forces applied by the fixing of the top sub to the hammer casing.

2. A make up system as claimed at claim 1 wherein the retainer ring is formed of a plurality of segments.

3. A make up system as claimed at claim 1 wherein the recess is formed of two axially spaced annular portions separated by an intermediate rib portion and wherein the outer circumferential face of the retainer ring is formed of a complementary configuration to be received in the recess to both sides of the rib portion.

4. A make up system as claimed as claim 1 wherein the recess has a width corresponding substantially to the width of both the retainer ring and the compressible ring.

5. A make up system as claimed as claim 1 wherein the circumferential face of the annular rebate is tapered inwardly such that its diameter at its innermost extent corresponds substantially to the inner diameter of the retainer ring.

6. A make up system as claimed at claim 5 wherein the flange is formed with a non tapered portion extending beyond the rebate.

7. A make up system claimed at claim 2 wherein the recess is formed of two axially spaced annular portions separated by an intermediate rib portion and wherein the outer circumferential face of the retainer ring is formed of a complementary configuration to be received in the recess to both sides of the rib portion.

8. A make up system as claimed at claim 2 wherein the recess has a width corresponding substantially to the width of both the retainer ring and the compressible ring.

9. A make up system as claimed at claim 3 wherein the recess has a width corresponding substantially to the width of both the retainer ring and the compressible ring.

10. A make up system as claimed at claim 2 wherein the circumferential face of the annular rebate is tapered inwardly such that its diameter at its innermost extent corresponds substantially to the inner diameter of the retainer ring.

11. A make up system as claimed at claim 3 wherein the circumferential face of the annular rebate is tapered inwardly such that its diameter at its innermost extent corresponds substantially to the inner diameter of the retainer ring.

12. A make up system as claimed at claim 4 wherein the circumferential face of the annular rebate is tapered inwardly such that its diameter at its innermost extent corresponds substantially to the inner diameter of the retainer ring.

13. A down-the-hole hammer comprising a hammer casing which has a top sub mounted to one end and supports a drill chuck at the other end, the casing accommodating a piston between the top sub and the drill chuck which is caused to reciprocate within the hammer casing, the top sub being adapted to be connected to a source of high pressure fluid, said top sub accommodating a valving system for controlling delivery of fluid to the space within the casing, said down-the-hole hammer having a make up system including the valving system having an annular flange thereon where the annular flange is capable of being slidably received within the hammer casing; an annular recess formed in the wall of the hammer casing; a retainer ring supported from said recess and extending inwardly beyond the inner face of the hammer casing, said flange being formed with an annular rebate around its perimeter adjacent the inner axial face to define a space between the retainer ring, the flange, and the side wall of the hammer casing, a compressible ring also received in the recess and located in the space, said compressible ting being compressed to fill the space as a result of the clamping forces applied by the fixing of the top sub to the hammer casing.

14. A down the hole hammer as claimed at claim 13, wherein, the retainer ring is formed of a plurality of segments.

15. A down the hole hammer as claimed at claim 13, wherein the recess is formed of two axially spaced annular portions separated by an intermediate rib portion and wherein the outer circumferential face of the retainer ring is formed of a complementary configuration to be received in the recess to both sides of the rib portion.

16. A down the hole hammer as claimed at claim 13, wherein the recess has a width corresponding substantially to the width of both the retainer ring and the compressible ring.

17. A down the hole hammer as claimed at claim 13, wherein the circumferential face of the annular rebate is tapered inwardly such that its diameter at its innermost extent corresponds substantially to the inner diameter of the retainer ring.

* * * * *